United States Patent [19]

Davis

[11] 4,202,787

[45] May 13, 1980

[54] PROTEC 3 CLEANING SOLUTION

[76] Inventor: C. Paul Davis, 18360 Oxnard St., Tarzana, Calif. 91356

[21] Appl. No.: 9,775

[22] Filed: Feb. 6, 1979

[51] Int. Cl.[2] ..... C23G 5/02; C11D 7/52

[52] U.S. Cl. ..... 252/171; 252/162; 252/170; 252/172; 252/8.8; 134/38; 134/40

[58] Field of Search ..... 252/171, 170, 172, 162, 252/8.8; 134/38, 40

[56] References Cited

U.S. PATENT DOCUMENTS

| | | | |
|---|---|---|---|
| 3,340,199 | 9/1967 | Clay et al. | 252/171 |
| 4,035,258 | 7/1977 | Reusser | 252/171 |
| 4,052,328 | 10/1977 | Figiel | 252/171 |
| 4,062,794 | 12/1977 | Figiel | 252/171 |
| 4,092,262 | 5/1978 | Reusser | 252/171 |
| 4,096,083 | 6/1978 | Clementson et al. | 252/171 |

OTHER PUBLICATIONS

The Condensed Chemical Dictionary, 6th Ed., 1961, p. 1221.

*Primary Examiner*—Mayer Weinblatt

[57] ABSTRACT

This invention relates to a cleaning composition for records, tape heads, magnetic surfaces, film, and the like. The cleaning composition comprises a mixture of fluorinated hydrocarbon, alcohol, antistatic agent, and lubricant in specific proportions. By the use of the cleaning solution of the present invention, cleaning, conditioning, and anti-static protection is afforded to a surface cleaned therewith.

2 Claims, No Drawings

PROTEC 3 CLEANING SOLUTION

BACKGROUND OF THE INVENTION

1. Field of the Invention

The present invention relates to the field of cleaning solutions, and more specifically, a cleaning solution for records, tape heads, magnetic surfaces, film information discs such as used in connection with computers and the like.

2. Prior Art

The advancements made in today's high fidelity phonograph systems have brought sound reproductions to an extremely high level. However, because such systems are of such quality and accuracy, should the grooves of a typical record contain even minor amounts of dirt, either in the form of particles of dust, smoke, and/or other undesirable materials, the presence of such material can be picked up by the phonograph stylus, magnified, and heard through the speakers. Compounding the problem is the fact that modern records are very susceptible to static electricity which causes dust and dirt to adhere to the surface. Because modern records have highly polished surfaces and for a variety of other reasons are now able to carry much more information, the need to keep the surfaces of such records extremely clean is well recognized in the art.

While the problems caused by dirt in the grooves of phonograph records have been recognized in the industry for some time, the means to effectively remove dirt from the relatively fragile surface of the record has been somewhat elusive. Recently, there has been a proliferation of devices which have attempted to remove the undesirable material from the grooves of the record. In these devices, various cleaning brushes, both with and without cleaning solutions, are used to clean the phonograph record. One such device is marketed under the name "Vac-O-Rec." This device removes dust from the phonograph record by applying a vacuum brush system to the surface thereof. Other record cleaning devices utilize brushes in combination with various cleaning solutions. While all these solutions do tend to clean the surface of the record somewhat, it has been found that such solutions all contain a number of shortcomings. It is believed that there are three basic problems associated with the care and handling of phonograph records, to wit: the cleaning of the record for better sound reproduction; the conditioning of the record such that wear of the stylus on the record grooves is diminished; and the ability to render the surface of the records substantially static-free so as to eliminate the build-up of dust. The prior art cleaning solutions have not been found to be effective as to all three of these problems.

The present invention overcomes the problems associated with prior art cleaning solutions and provides a composition which not only cleans the record surface, but also conditions it and renders it substantially static-free.

Another problem relates to the need to keep magnetic computer discs free from even microscopic particles of dirt. The industry has likewise recognized the need to maintain magnetic discs free from such particles. In the past, complex machinery was used to clean the discs. Such machinery is not believed to be effective in the removal of finely divided particles such as cigarette smoke, microscopic oil particles, oxide deposits and the like. The problem with such particles is that if not removed from the magnetic disc surface, a "head crash"

can be caused. This can result not only in a total destruction of the head, but also in the destruction of the magnetic disc and the information contained on it. The prior art has recognized such problems and in addition to using the machines mentioned above, has applied various cleaning solutions to the disc heads as well as to the discs themselves. In a similar fashion, tape heads and magnetic tape are also cleaned especially in a commercial setting so as to remove static electricity, dust, and magnetic debris from the tape and tape heads. While prior art solutions are believed to be somewhat effective, they all suffer a number of shortcomings. For example, some require very long drying periods, some do not sufficiently remove static from the surface, some require special handling and the like.

As to the specific types of similar solutions to that set forth herein, reference is made to U.S. Pat. Nos. 4,062,794; 4,052,328; 3,509,060 and 3,340,199. These patents disclose various mixtures of trichlorotrifluoroethane and other solvents used for cleaning a wide range of surfaces.

U.S. Pat. No. 3,509,060 does disclose a cleaning composition containing an anti-static agent. However, such cleaning composition is different from the cleaning composition of the invention, and is used to clean windows and the like. Other prior art references directed to cleaning compositions are U.S. Pat. Nos. 4,092,262; 4,070,299; 4,035,258; and 3,477,952.

BRIEF SUMMARY OF THE INVENTION

The present invention relates to a multi-purpose cleaning solution for cleaning records, magnetic discs, tape heads and the like. The cleaning solution of the present invention not only cleans the surfaces to which it is applied, but also conditions the surface so as to enable the stylus to create less wear on the grooves of a record. Further, the cleaning solution of the instant invention provides anti-static protection. In this manner, the problems associated with dust and other finely divided debris is substantially overcome. These and other benefits are achieved by a solution comprising:

(a) from about 80–95% of a fluorinated hydrocarbon solvent;

(b) from about 5–20% of an alcohol;

(c) from about 0.051–0.254% of an anti-static agent; and (d) from about 0.019–0.047% of a lubricant.

It should be understood that all percentages listed herein are volume unless otherwise specified.

The novel features which are believed to be characteristic of the invention both as to its organization and method of operation, together with further objectives and advantages thereof will be better understood from the following examples considered in connection with the accompanying explanation in which preferred embodiments of the invention are illustrated and explained by way of examples. It is to be expressly understood, however, that the examples are for the purpose of illustration and description only, and are not intended as a definition of the limits of the invention.

DETAILED DESCRIPTION OF THE INVENTION

As discussed hereinabove, the instant invention is directed to a cleaning composition for cleaning records, magnetic discs, tape heads and other similar equipment.

Broadly, the cleaning solution of the present invention comprises:

(a) from about 80 to 95% of a fluorinated hydrocarbon;

(b) from about 5 to 20% of an alcohol;

(c) from about 0.051%–0.254% of an anti-static agent; and (d) from about 0.019–0.047% of a lubricant.

All percentages being percent by volume.

Preferably, the fluorinated hydrocarbon is trichlorotrifluoroethane. Such product is sold under the trade name Freon TF.

With respect to the alcohol, the preferred alcohol of the present invention is isopropyl alcohol although other alcohols are within the scope of this invention. With respect to the lubricant, the preferred lubricants are short chain telomers of tetrafluoroethylene. Such lubricant is sold in the art under the trade name Vydax 550. Vydax 550 has a solid content of 5%, a viscosity (Brookfield) at 77° F. and 20 rpm, of 12 cps., a density at 77° F., of 1.59 g/ml. and an average particle size of approximately 5 microns. Vydax 550 is a fluorotelomer dispersion wherein the solvent is trichlorotrifluoroethane ($CCl_2F$ - $CClF_2$). Such solvent has a boiling point of approximately 118° F., a freezing point of −31° F. and a density of 1.56 gms/ml. While such lubricant has been found to be especially suited for use in connection with records, tape heads and the like, this does not mean that the present invention is to be so limited. Other lubricants are within the scope of the present invention.

With respect to the anti-static agent used in the present invention, the preferred embodiment contemplates the use of stearamidopropyldimethyl-B-hydroxyethylammonium nitrate.

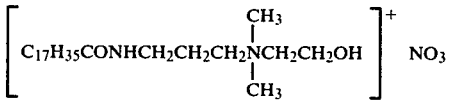

Such anti-static agent is sold under the trade name Cyastat.

The following is a specific example of the cleaning composition of the present invention:

trichlorotrifluoroethane . . . 89.9%,
isopropyl alcohol . . . 9.98%,
anti-static agent (Cyastat) . . . 0.085%,
lubricant (Vydax 550) . . . 0.035%.

The above composition was prepared merely by mixing the various ingredients together and was applied to the surface of a record. The surface of the record was examined and it was found that the record was substantially free of all particles of dust, dirt and the like. The record was tested and it was determined that less drag was created on the stylus ultimately resulting in less wear both on the stylus and the record. Further, the anti-static qualities of the record were examined. It was found that after applying the above cleaning composition, good anti-static protection was achieved.

While the invention is described in its preferred embodiment, it is to be understood that the words which have been used are words of description rather than of limitation, and that changes within the perview of the appendent claims may be made without departing from the true scope and spirit of the invention in its broader aspects.

I claim:

1. A cleaning composition for records, magnetic discs, and tape heads consisting of:

(a) from about 80–90% of trichlorotrifluoroethane;

(b) from about 5–20% of isopropyl alcohol;

(c) from about 0.051–0.254% of a fatty quaternary ammonium compound; and (d) from about 0.019–0.047% of a short-chain tetrafluoroethylene telomer dispersed in said trichlorotrifluoroethane.

2. A method of cleaning the surface of a record, tape head or magnetic disc comprising applying the composition as set forth in claim 1 to the surface thereof and permitting the composition to evaporate.

* * * * *